US009747874B2

(12) United States Patent
Holm et al.

(10) Patent No.: US 9,747,874 B2
(45) Date of Patent: Aug. 29, 2017

(54) ELECTRONIC GUITAR PICK AND METHOD

(71) Applicant: Capacitron, LLC, Las Vegas, NV (US)

(72) Inventors: Peter Douglas Holm, San Francisco, CA (US); Brandon Williams, San Jose, CA (US)

(73) Assignee: Capacitron, LLC, Las Vegas, NV (US)

( * ) Notice: Subject to any disclaimer, the term of this patent is extended or adjusted under 35 U.S.C. 154(b) by 0 days.

(21) Appl. No.: 15/171,127

(22) Filed: Jun. 2, 2016

(65) Prior Publication Data

US 2017/0032769 A1 Feb. 2, 2017

Related U.S. Application Data

(63) Continuation of application No. 14/867,212, filed on Sep. 28, 2015, now Pat. No. 9,361,865, which is a (Continued)

(51) Int. Cl.
*G10D 3/16* (2006.01)
*G10H 3/18* (2006.01)
(Continued)

(52) U.S. Cl.
CPC ..... *G10D 3/163* (2013.01); *F21V 23/0442* (2013.01); *F21V 33/008* (2013.01); *G10D 3/16* (2013.01); *G10H 1/0008* (2013.01); *G10H 1/02* (2013.01); *G10H 1/18* (2013.01); *G10H 3/00* (2013.01); *G10H 3/18* (2013.01); *G10H 3/181* (2013.01); *G10H 3/186* (2013.01); *F21Y 2115/10* (2016.08); *G10H 2220/021* (2013.01);
(Continued)

(58) Field of Classification Search
CPC ..... G10D 3/16; G10D 3/163; G10H 3/181; G10H 3/18; G10H 3/00
USPC ..... 84/322, 743, 737, 722
See application file for complete search history.

(56) References Cited

U.S. PATENT DOCUMENTS 3,127,774 A * 4/1964 Fischer ..... G01C 19/42 318/649
3,530,227 A * 9/1970 Terlinde ..... G10H 1/342 84/322
(Continued)

OTHER PUBLICATIONS

"U.S. Appl. No. 14/092,709, Non Final Office Action mailed Oct. 9, 2014", 9 pgs.
(Continued)

*Primary Examiner* — David Warren
*Assistant Examiner* — Christina Schreiber
(74) *Attorney, Agent, or Firm* — Schwegman Lundberg & Woessner, P.A.

(57) ABSTRACT

An electronic guitar pick, system, system and method may include an enclosure forming a cavity, the enclosure having a first end that is substantially pointed and a second end opposite the first end that is substantially flat, the enclosure having a thickness proximate the cavity greater than a thickness proximate the first end. The electronic guitar pick, system, and method may further include a sensor contained, at least in part, within the cavity and configured to generate a sensor output based on an interaction with the enclosure and a sensory output device, communicatively coupled to the sensor, configured to output a sensory output based, at least in part, on the sensor output.

6 Claims, 6 Drawing Sheets

Related U.S. Application Data continuation of application No. 14/092,709, filed on Nov. 27, 2013, now Pat. No. 9,147,382.

(60) Provisional application No. 61/730,366, filed on Nov. 27, 2012.

(51) Int. Cl.

| | |
|---|---|
| ***G10H 3/00*** | (2006.01) |
| ***G10H 1/02*** | (2006.01) |
| ***G10H 1/18*** | (2006.01) |
| ***F21V 33/00*** | (2006.01) |
| ***G10H 1/00*** | (2006.01) |
| ***F21V 23/04*** | (2006.01) |
| *F21Y 115/10* | (2016.01) |

(52) U.S. Cl.

CPC . *G10H 2220/061* (2013.01); *G10H 2220/191* (2013.01); *Y10T 29/49117* (2015.01)

(56) References Cited

U.S. PATENT DOCUMENTS 4,064,781 A * 12/1977 Fals ..... G10D 3/163 84/322
4,171,659 A * 10/1979 Tumminaro ..... G10H 3/181 84/315
4,235,144 A * 11/1980 Lubow ..... G10H 1/06 84/322
5,300,730 A * 4/1994 Ekhaus ..... G10D 3/163 84/320
5,693,904 A * 12/1997 Kihneman ..... G10H 3/181 84/725
5,864,083 A * 1/1999 Caren ..... G10H 1/46 84/322
6,245,976 B1 * 6/2001 Sander ..... G10D 3/163 84/320
6,946,592 B1 * 9/2005 Chick ..... G10D 3/163 84/322
8,088,988 B2 * 1/2012 Randazzo ..... G10H 3/143 84/723
8,395,038 B2 * 3/2013 Smith ..... G10D 3/163 84/322
8,766,071 B2 * 7/2014 Risolia ..... G10D 3/163 84/322
8,780,086 B2 * 7/2014 Salsman ..... G06F 3/042 345/156
9,147,382 B2 * 9/2015 Holm ..... G10D 3/163
9,361,865 B2 * 6/2016 Holm ..... G10D 3/163
2002/0162445 A1 * 11/2002 Naples ..... G10H 1/365 84/610
2006/0272489 A1 * 12/2006 Remignanti ..... G10H 1/0091 84/723
2007/0028746 A1 * 2/2007 Herring ..... G10D 3/163 84/322
2011/0034300 A1 * 2/2011 Hall ..... A63B 5/11 482/1
2012/0200533 A1 8/2012 Salsman
2014/0144308 A1 5/2014 Holm et al.
2016/0093274 A1 3/2016 Holm et al.

OTHER PUBLICATIONS

"U.S. Appl. No. 14/092,709, Notice of Allowance mailed May 22, 2015", 13 pgs.
"U.S. Appl. No. 14/092,709, Response filed Jan. 9, 2015 to Non Final Office Action mailed Oct. 9, 2014", 8 pgs.
"U.S. Appl. No. 14/867,212, Notice of Allowance mailed Feb. 12, 2016", 11 pgs.

* cited by examiner

ELECTRONIC GUITAR PICK AND METHOD

PRIORITY APPLICATION(S)

This application is a continuation of U.S. application Ser. No. 14/867,212, filed Sep. 28, 2015, which application is a continuation of U.S. application Ser. No. 14/092,709, filed Nov. 27, 2013, issued Sep. 29, 2015 as U.S. Pat. No. 9,147,382, which application claims the benefit of priority under 35 U.S.C. §119(e) to U.S. Provisional Patent Application No. 61/730,366, filed Nov. 27, 2012, all of which are incorporated herein by reference in their entireties.

TECHNICAL FIELD

The subject matter disclosed herein generally relates to an electronic guitar pick.

BACKGROUND

Guitar picks are conventionally a piece of molded plastic, metal, or other suitable material. The material is typically formed in a generally rounded triangular shape approximately one (1) millimeter thick. A narrow end is configured to pick or strum the strings on a guitar or other string instrument and a wide end configured to be gripped by an individual playing the guitar or string instrument, such as with the thumb and forefinger. While a guitar may be played by strumming the guitar with the fingers of a person playing the guitar, by holding and manipulating the pick the player may play a guitar or stringed instrument relatively more precisely than may be achieved with fingers alone and without causing significant stress on their fingers.

BRIEF DESCRIPTION OF THE DRAWINGS

Some embodiments are illustrated by way of example and not limitation in the figures of the accompanying drawings.

DETAILED DESCRIPTION

Example methods and systems are directed to recommended actions to promote social network activity. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

Because a guitar pick is intended to be held and manipulated by the fingers and serve the relatively simple purpose of strumming or picking guitar strings, guitar picks are conventionally relatively small, mechanically simple, and generally without additional features other than aesthetic adornments, such as graphics and the like. Thus, guitar picks are conventionally produced from a single piece of material, whether by molding, milling, grinding, and the like. Guitar picks are conventionally as thin as practical to provide ease of gripping while maintaining sufficient mechanical robustness to avoid breaking, as noted above conventionally approximately one (1) millimeter thick. Thus, a pick is conventionally much thinner than a typical circuit board and/or battery. Finally, because input devices such as buttons, switches, and the like may be difficult to manufacture in a size small enough to fit on a pick, and may be difficult to operate at such small sizes, the guitar picks themselves conventionally do not do anything active, instead merely being passive mechanisms by which an instrument is played.

An electronic guitar pick has been developed that may maintain desired qualities of thinness and robustness while also incorporating electronics that make take a guitar pick from being a passive and inert piece of material into an active device. The electronic guitar pick includes electronics that translate the motion of the pick into electronic signals, such as with an accelerometer, a gyroscope, and/or other sensors. The electronic signals may be utilized internal to the pick to flash a light or generate other sensory output. Alternatively or additionally, the electronic signal may be output or may be utilized to generate an output from the pick that may be transmitted, such as by a wireless transmitter, to an external receiver. The signal may then be utilized to create sensory experiences external to the pick.

Figure 1A:
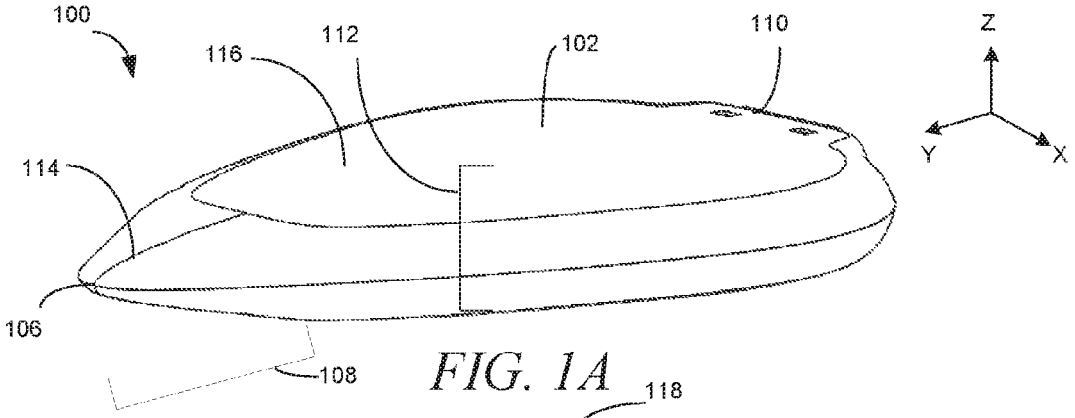
FIGS. 1A-1C are illustrations of an electronic guitar pick, in an example embodiment.
Figure 1B:
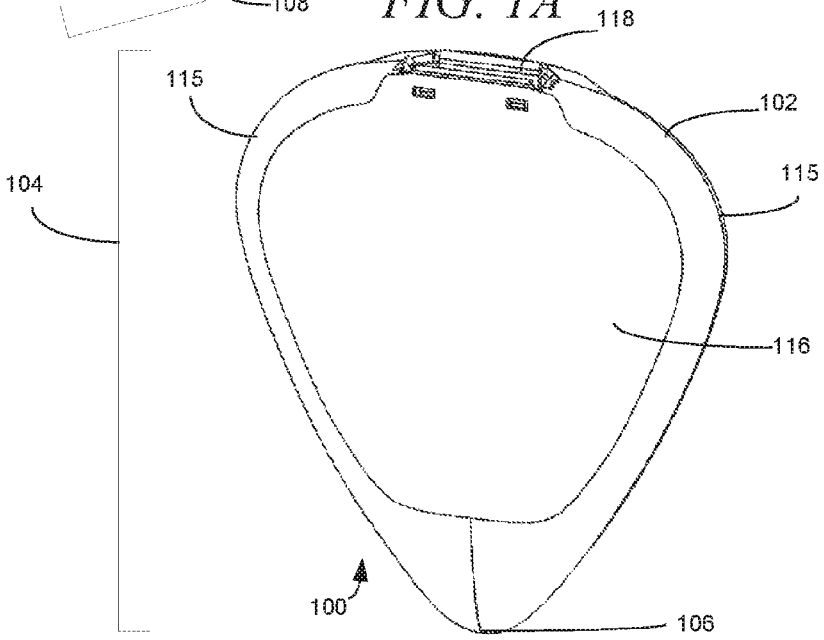
Figure 1C:
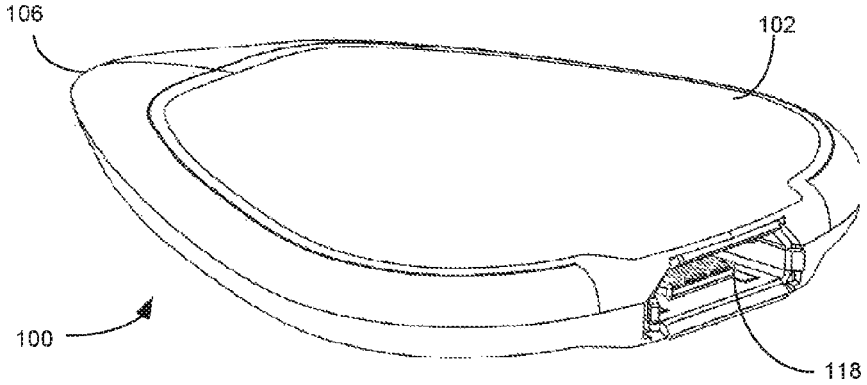

FIGS. 1A-1C are illustrations of an electronic guitar pick 100, in an example embodiment. As noted above, while the electronic guitar pick 100 will be discussed with respect to guitars and use with respect to guitars, it is to be understood that the electronic guitar pick 100 is applicable to any of a variety of circumstances and any of a variety of articles, such as, but not necessarily limited to, stringed musical instruments. It is emphasized that, while the function of the electronic guitar pick 100 may be configured to operate based on playing a guitar, in such examples the function of the electronic guitar pick 100 would operate without playing a guitar so long as the electronic guitar pick 100 were manipulated in a manner similar to the playing of a guitar such that the sensors included herein detected the similar manipulation. Moreover, while the electronics of the electronic guitar pick 100 may be configured and optimized for the playing of a guitar, the electronics may be adjusted for use in other circumstances.

The electronic guitar pick 100 includes an enclosure 102 or housing. The enclosure 102 may be made from any of a variety of generally rigid and resilient materials, including various plastics and various metals. In various examples, the enclosure 102 is made, at least in part, from translucent or semitransparent plastic to allow light to pass through, such as from light generated by electronics contained within the enclosure 102. In various examples, a whole of the enclosure 102 is made from translucent plastic or a portion of the enclosure 102 is made from translucent plastic with another portion made from opaque plastic. In an example, the translucent plastic is light diffused polycarbonate.

The enclosure 102 has an enclosure length 104 along its primary axis, from the tip 106 of a first end 108 of the enclosure 102 to a second end 110 of the enclosure 102. As illustrated, the second end 110, while somewhat rounded, is understood to be substantially flat in contrast with the tip 106. In certain examples, the enclosure length 104 is approximately one (1) inch or twenty-six (26) millimeters. In various examples, the enclosure length 104 may be substantially the same or similar to that of a conventional guitar pick.

The enclosure 102 has a varying thickness. The enclosure 102 has a middle thickness 112 corresponding with an interior cavity of the enclosure 102 (see FIG. 2). In an example, the material enclosure 102 is from approximately 0.25 millimeters and 0.5 millimeters thick and the cavity is approximately 2.5 millimeters thick, leading to a middle thickness 112 of approximately 3.5 millimeters.

Starting at the first end 108, the thickness tapers to the tip 106. In an example, an end thickness 114 proximate the tip 106 is approximately one (1) millimeter. It is noted that, following the end thickness 114, the taper increases significantly, ending in a point at the tip 106. In various examples, the end thickness 114 is approximately equivalent to that of a conventional guitar pick, creating a same or similar "playing edge" at the tip 106 as a conventional guitar pick.

It is noted that what applies to the tip 106 and first end 108 may apply generally to one or both of the other corners 115 of the pick (the tip 106 may also be understood as a corner 115). Thus, one or both of the other corners 115 may likewise have a taper and/or a thickness proximate a tip of the corner 115 of approximately one (1) millimeter. Thus, both the tip 106 and the corners 115 may have a thickness resulting in the same or similar "playing edge" as a conventional guitar pick. In such examples, any or all of the tip 106 and corners 115 may be utilized to pluck or strum the strings of an instrument.

In the illustrated example, the taper in the first end 108 is not uniform. As illustrated, a top side 116 of the enclosure 102 tapers less than a bottom side (not pictured) of the enclosure in the first end 108 and the tip 106 is not at a midpoint of the middle thickness 112. However, it is to be understood that, in various examples, the taper may be uniform in the first end 108. It is further to be understood that the label of top side 116 and bottom side is arbitrary and that either side may be considered "top" or "bottom", as appropriate.

The electronic guitar pick 100 includes an electronic connector 118. As illustrated, the connector 118 is a female connector, though it is to be understood that, in various examples, the connector 118 may be a male connector. The connector 118 may be any of a variety of connectors that may transmit power and/or electronic data to and/or from the electronic guitar pick 100. In an example, the connector 118 is a universal serial bus (USB) connector. Various alternative connectors, whether standard or proprietary, may be used instead or in addition. In an example, the connector 118 is configured to transmit power without transmitting electronic data.

Figure 2:
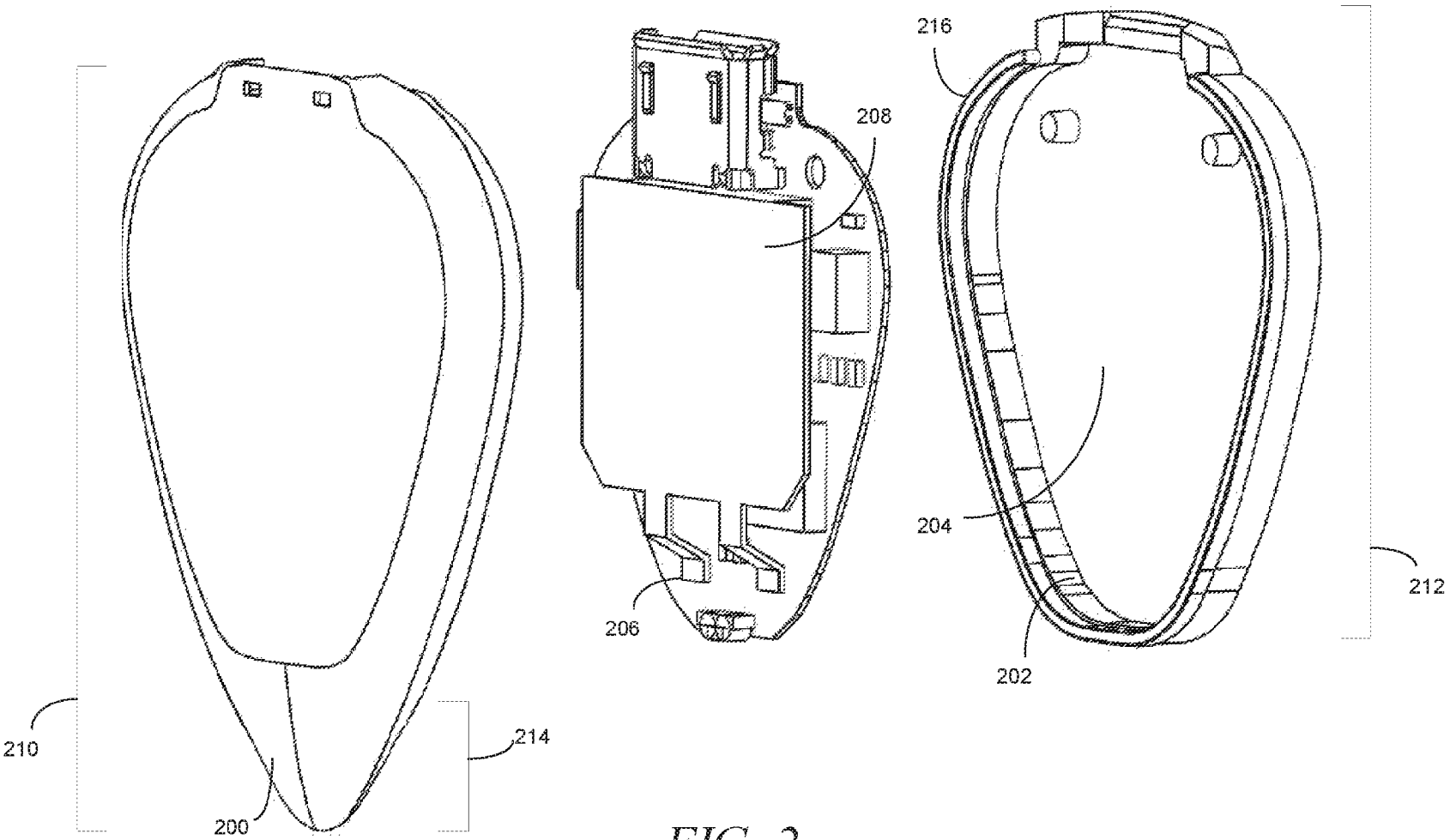
FIG. 2 is an exploded image of an electronic guitar pick, in an example embodiment.

FIG. 2 is an exploded image of an electronic guitar pick 100, in an example embodiment. The enclosure 102 includes a first portion 200 and a second portion 202. The enclosure forms a cavity 204 in which a circuit board 206 is seated. The circuit board 206 includes electronic components 208, such as an accelerometer, a gyroscope, a battery, a light emitting diode, a wireless transmitter, circuitry for the connector 118, and control circuitry (see FIG. 3).

The first portion 200 includes the first end 108 of the enclosure 102. The second portion 202 is configured to be mechanically or adhesively coupled with the first portion 200. As illustrated, the second portion 202 does not comprise or include the first end 108. Rather, while the first portion 200 has a first portion length 210 that is either the same or approximately the same as the enclosure length 104 generally, the second portion 202 has a second portion length 212 that is approximately equal or less than the enclosure length 104 less a first end length 214 of the first end 108.

As illustrated, the second portion 202 includes a circumferential member 216 that is configured to be seated, at least in part, within the first portion 200 in order to couple the second portion 202 to the first portion 200. As such, in such an example, the first portion 200 forms an overall shape of the enclosure 102 while the second portion 202 acts as a cap or piece that secures the circuit board 206 within the cavity 204. It is to be recognized, however, that alternative examples of the electronic guitar pick 100 may have each of the first and second portions 200, 202 follow the approximate contours of the enclosure 102, or may implement the enclosure 102 according to any other suitable arrangement.

The cavity 204 generally extends from proximate the first end 108 to proximate the second end 110. The cavity 204 is formed between the first portion 200 and the second portion 202 of the enclosure 102. The cavity 204 may be sized in two or all three spatial dimensions to admit the circuit board 206 and the volume of the cavity 204 may be optimized to fit the circuit board 206. In various examples, the volume of the cavity 204 may be sized both to fit and admit the circuit board 206 and to provide, at least in part, a desired middle thickness 112 of the electronic guitar pick 100, such as for a preferred tactile user experience.

Figure 3:
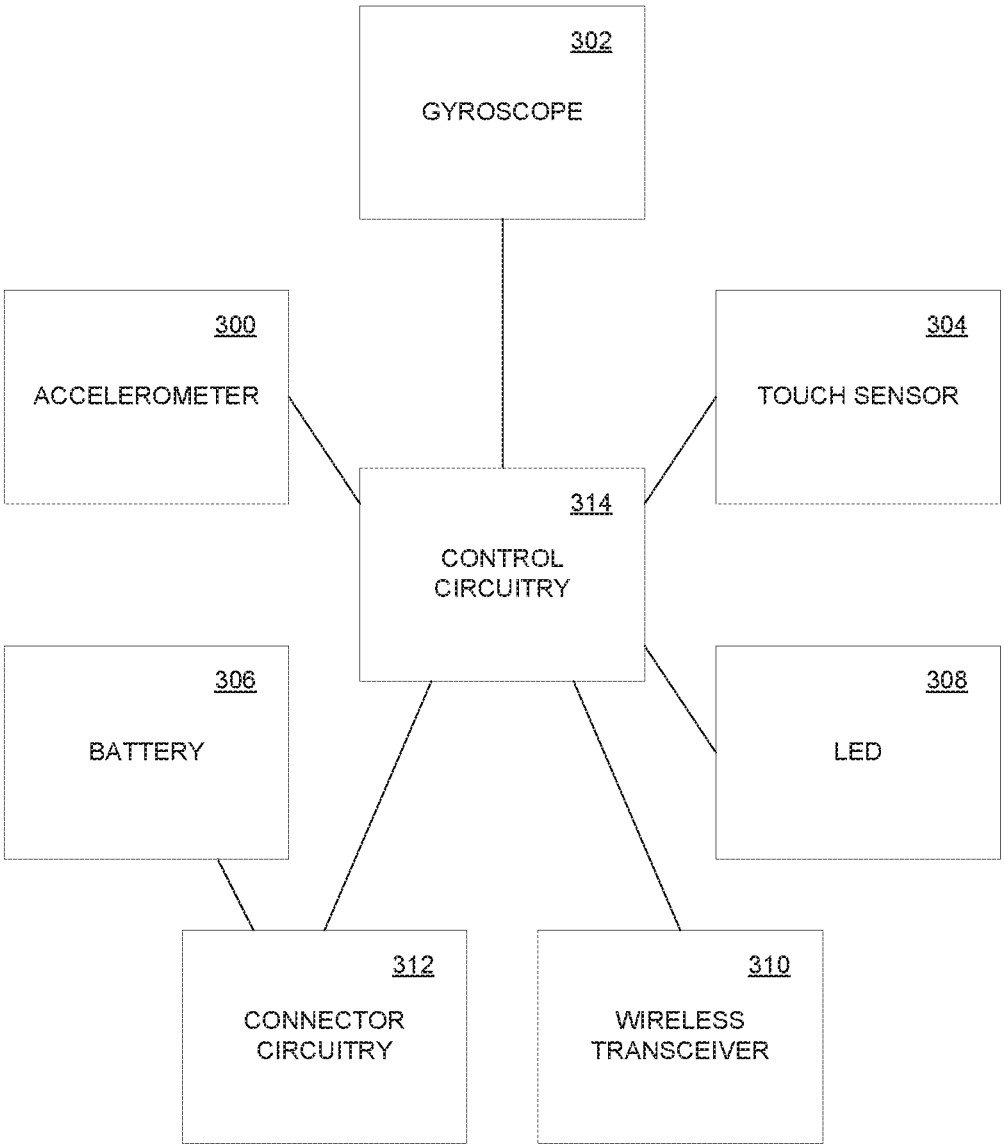
FIG. 3 is a block diagram of a circuit board, in an example embodiment.

FIG. 3 is a block diagram of the circuit board 206, in an example embodiment. While the circuit board 206 is presented herein as a single circuit board, it is to be recognized and understood that the components of the circuit board 206 may be divided between and among multiple circuit boards as desirable for particular implementations and examples.

The circuit board 206 includes an accelerometer 300, a gyroscope 302, a touch sensor 304, a battery 306, a light emitting diode (LED) 308, a wireless transceiver 310, connector circuitry 312 for the connector 118, and control circuitry 314 (collective, the "electronics" of the electronic guitar pick 100). In various examples, any one or more of the components of the circuit board 206 may be omitted and various additional sensors and/or components generally may be added, as desired.

The accelerometer 300 is a sensor configured to detect acceleration of the accelerometer 300 and, by extension, articles coupled to the accelerometer 300, such as the electronic guitar pick 100 generally. The accelerometer 300 provides an output indicative of detected acceleration. In various examples, the accelerometer 300 provides a binary output that indicates that acceleration is either above or below a predetermined threshold level. In various example, the accelerometer 300 provides multiple possible outputs, including an analog output acceleration as measured. In the case of the binary output, the output may be transmitted directly to the LED 308 or the wireless transceiver 310 for direct use by those components. In the case of the binary or the multiple or analog outputs, the output may be transmitted to any of the LED 308, the wireless transceiver 310, the connector circuitry 312, or the control circuitry 314.

The accelerometer 300 may provide a combined sensor and control function, in various examples. The accelerometer 300 may sense motion and/or acceleration of the electronic guitar pick 100 as the electronic guitar pick 100 is being used to play a guitar. The accelerometer may directly trigger the LED 308, for instance, which may be a control function, or may output the sensed acceleration to the control circuitry 314, for instance, which may utilize the sensed acceleration.

The accelerometer 300 may be a three-axis accelerometer. The accelerometer may differentiate between acceleration along the Z-axis (FIG. 1A), which may be indicative of strumming or picking of guitar strings, and acceleration along the X- and Y-axes, which may be indicative of non-playing motions of the electronic guitar pick 100 or motions which are not conventionally playing motions. X- and Y-axis acceleration may be utilized to provide a sensor output or may be ignored, in various examples and as desired. X- and Y-axis acceleration may be utilized as a control input, such as to cause the LED 308 to flash or to place the electronic guitar pick 100 in different operation modes (e.g., change an output of the LED 308, change a sensitivity of the accelerometer 300, engage or disengage the wireless transceiver 310, and so forth). In examples where X- and Y-axis acceleration is a control input, such as to flash the LED 308, the measured acceleration may be subject to the same, similar, or different thresholds as with acceleration on the Z-axis.

The gyroscope 302 is a sensor configured to detect an orientation of the gyroscope 302 to a reference point and, by extension, articles coupled to the gyroscope 302, such as the electronic guitar pick 100 generally. The reference point may be ground or a provided reference plane, such as may be provided by the control circuitry 314 via the wireless transceiver 310 or the connector circuitry 312. A user of the electronic guitar pick 100 may utilize the function of the gyroscope 302 to change an orientation of the electronic guitar pick 100 to the reference point or plane to generate an output. As with the accelerometer 300, the output of the gyroscope 302 may be utilized as a control output, such as to flash the LED 302, or may be utilized to control a function or operation of the electronic guitar pick 100, such as by the control circuitry 314. Thus, a user of the electronic guitar pick 100 may, for instance, cause the LED 308 to flash or may change the operation of the electronic guitar pick 100 by changing an angle at which the electronic guitar pick 100 is held relative to the reference.

The touch sensor 304 may be a touch sensor sensitive to a change in capacitance or resistance, such as what may occur from contact with human skin, pressure, change in sensed light, and so forth. The touch sensor 304 may be utilized as an on/off function to turn the electronics of the electronic guitar pick 100 on when a touch is sensed and off when touching is not sensed (it is to be recognized that delays and smoothing functions may be utilized to prevent undesired changes in the output from the touch sensor 304 from undesirably turning the electronic guitar pick 100 off and/or on). The touch sensor 304 may additionally or alternatively be utilized as a control output, such as to select, change, or otherwise control functions of the electronic guitar pick 100.

The battery 306 may provide power to the electronics generally and may be a rechargeable battery or a replaceable battery, such as a button battery or other battery with suitable voltage, current, and physical profile characteristics. The battery 306 may, in various examples, be accessed and removed/replaced by separating the first enclosure portion 200 and the second enclosure portion 202. Where the battery 306 is a rechargeable battery, the battery 306 may be recharged via the connector 118, via inductive energy via a coil, or according to any of a variety of wired or wireless energy transfer methods known in the art. The battery 306 may supply power to the various components via a power bus (not illustrated).

The LED 308 may be one or more LEDs 308 of one or more colors 308. While the LED 308 is referred to herein as an LED, it is to be understood that any sensory output device may be utilized, including light emitting sensory output devices, audio emitting sensory output devices, such as a speaker, and so forth. Any light emitting element may be utilized in addition to or in place of the LED 308, including a laser and a conventional light.

The LED 308 may emit light upon receiving a control signal either directly from the sensors 300, 302, 304, or via the control circuitry 314, the wireless transceiver 310, and/or the connector circuitry 312. The LED 308 may emit light in the same manner regardless of the control signal or may emit light in varying fashion depending on the nature of the control signal. The LED 308 may be configured to emit light according to a predetermined duration (i.e., the same flash of light every time the control signal is received) or of varying duration (e.g., a longer flash of light for certain control inputs and a shorter flash of light for other control inputs). In various examples, an intensity of the LED 308 may be adjusted, such as based on a control signal.

Figure 4:
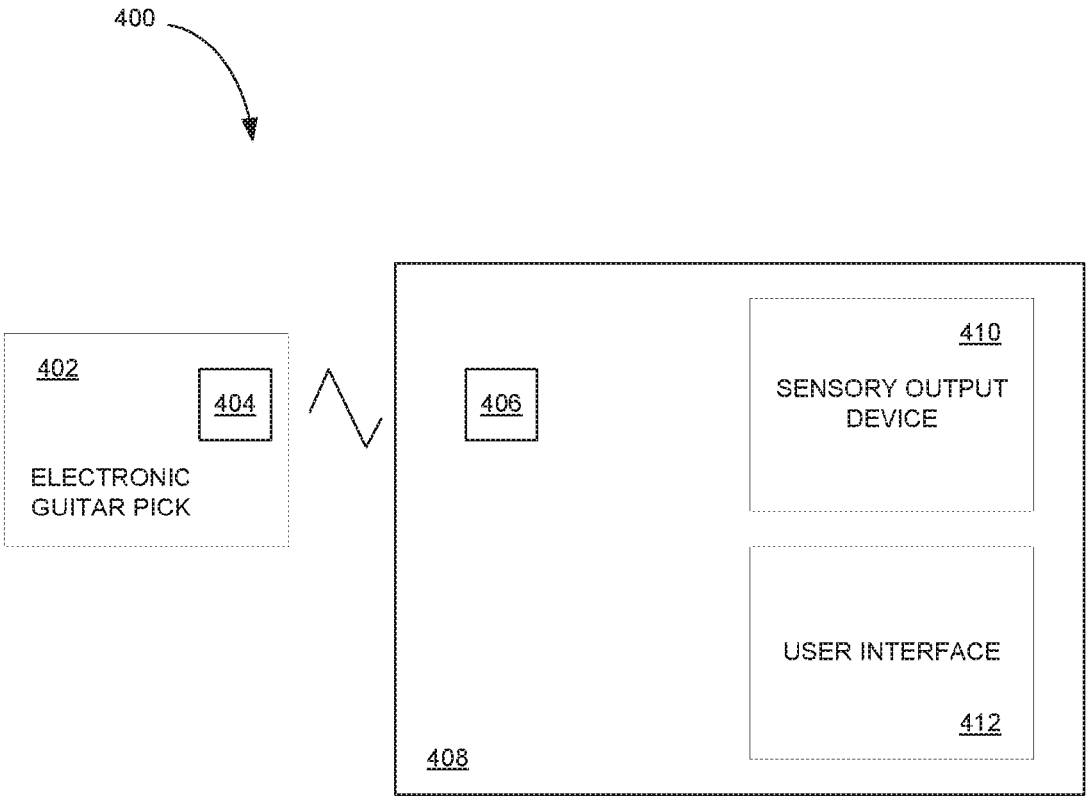
FIG. 4 is a block diagram of a system including an electronic guitar pick 402, in an example embodiment.

The wireless transceiver 310 may send and receive wireless signals, such as from an external wireless transceiver (FIG. 4). The wireless transceiver 310 may optionally be only a transmitter or only a receiver, as desired. The wireless transceiver 310 may output signals from the sensors 300, 302, 304 and/or control signals from the control circuitry 314. The wireless transceiver 310 may receive control signals from an external controller, such as may change the operating parameters of the electronic guitar pick 100.

The connector circuitry 312 may include circuitry coupled to the connector 118 that may receive and direct signals received via the connector 118. For instance, the connector circuitry 312 may direct a power signal to the battery 306 to recharge the battery 306. The connector circuitry 312 may direct control signals to the control circuitry 314. Similarly, the connector circuitry 312 may direct control signals received from the sensors 300, 302, 304 and/or the control circuitry 314 to the connector 118 for wired transmittal of the signals to a receiver external to the electronic guitar pick 100.

The control circuitry 314 may be a programmable controller, microcontroller, or processor, or discrete components selected and configured to provide control functionality, or a custom integrated circuit or chip package, as appropriate. The control circuitry 314 may generally control the electronics of the electronic guitar pick 100. The control circuitry 314 may, in various examples, receive signals form the sensors 300, 302, 304 and translate those signals into control signals for the LED 308 and/or for transmittal to an external system.

The control circuitry 314 may include an electronic storage that may be utilized to store sensor data and/or system commands. For instance, the electronic storage may be volatile memory, such as random access memory (RAM) or non-volatile memory or storage, such as flash memory. The electronic storage may store criteria by which sensor outputs translate into flashing by the LED 308, as disclosed herein, and to store sensor output for transmittal to an external system for use by the external system or display to a user, as disclosed herein.

The control circuitry 314 may control the LED 308 and/or provide the output to the external device according to inputs from any and all of the sensors 300, 302, 304, and may factor the inputs from multiple sensors 300, 302, 304 in generating a control signal for the LED 308 and/or the external device. Thus, for instance, a signal from the accelerometer 300 indicating a conventional picking motion, i.e., an acceleration along the Z-axis of a particular magnitude, may cause the control circuitry 314 to output a first control signal that causes the LED 308 to flash a first color for a first duration. A signal from the accelerometer 300 indicating acceleration along the X-axis and a signal from the gyroscope 302 that the electronic guitar pick 100 has rotated ninety (90) degrees from a reference point may cause the LED 308 to flash a second color for a second duration, both different from the first color and first duration, respectively. A signal from the touch sensor 304 that indicates that the user is touching, e.g., the second portion 202 of the enclosure 102 may cause the first and second colors and the first and second durations to change, i.e., change the settings by which the electronic guitar pick 100 creates sensory outputs.

In an example, the touch sensor 304 includes one or more sensors on the enclosure 102. In such an example, a sequence of touches of the sensor 304, such as according to a predetermined pattern, may produce a sensor signal or control signal from the touch sensor 304. For instance, if the touch sensor 304 detects a touch for approximately one (1) second, a lack of a touch for two (2) seconds, and a second touch for three (3) seconds, the touch sensor 304 and/or the controller may trigger a control output to the LED 308. Alternatively, the touch sensor 304 may register a sequence of touches at separate locations. For instance, a touch sensor 304 including multiple sensors arranged in a circular pattern on the enclosure 102 may register a clockwise and/or counterclockwise sequence of touches that may indicate, for instance, the user has rubbed a thumb or finger clockwise and/or counterclockwise around the enclosure 102, and, as a result, trigger a control or sensor output.

In various examples, the electronic guitar pick 100 is configurable, e.g., through inputs received via the connector 118 and/or via the wireless transceiver 310. Thus, for instance, a user may change what colors and what light emitting durations are associated with what combinations of signals from the sensors 300, 302, 304. Thus, the output of the electronic guitar pick 100 may be configurable for various users operating in various circumstances. A computer program or application may be utilized to interface with the electronic guitar pick 100 and provide a user interface for a user to program the settings of the electronic guitar pick 100 and convert the settings as selected by the user into commands that may be uploaded to the control circuitry 314 via the connector 118 and/or the wireless transceiver 310.

FIG. 4 is a block diagram of a system 400 including an electronic guitar pick 402, in an example embodiment. The electronic guitar pick 402 may be the electronic guitar pick 100 in various examples. The electronic guitar pick 402 optionally does not include the LED 308.

The electronic guitar pick 402 includes a wireless transceiver 404 that can communicate with an external wireless transceiver 406. The external wireless transceiver 406 is communicatively coupled to or is a component of an external system 408 that is optionally configured according to various functions. Optionally the wireless transceiver 404 is supplemented with or replaced by a wired connection via a connector, such as the connector 118.

In an example, the external system 408 optionally includes a sensory output device 410. As noted above, the sensory output device 410 may be any sensory output device that user of the electronic guitar pick 402 may desire to control, at least in part, via manipulation of the electronic guitar pick 402. Thus, the sensory output device 410 may be or include: lights, such as one or more LEDs, lasers, video units and displays, and the like; audio outputs, including speakers that may produce a variety of sounds, such as tones, music, and the modulation of music, such as music generated by a guitar the user of the electronic guitar pick 402 is playing; and effects generators, such as a fog generator, effect cannon, and the like, among other potential sensory output devices. The sensory output device may be located in any of a variety of places, including as a stand-alone unit, as part of the guitar which the user may be playing, or incorporated into any of a variety of other devices or articles. As such, by manipulating the electronic guitar pick 402 in a same or similar manner as described above with respect to the electronic guitar pick 100, the user of the electronic guitar pick 402 may control the sensory output device 410 of the external system 408 in the same or similar manner as the user controls the LED 308 or other sensor output device internal to the electronic guitar pick 402.

In an example, the external system 408 optionally includes a user interface 412, such as an electronic display or audio speaker, configured to provide information relating to the manipulation of the electronic guitar pick 402. Thus, for instance, the external system 408 may receive sensor data from the electronic guitar pick 402 and display the sensor data, in whole or in part, on a display of the user interface 412 or give audio information about the same. A user may thereby be provided with statistics on the nature of their playing a guitar, for instance concerning tempo, adherence to a beat or tempo, picking technique, such as the orientation of the electronic guitar pick 402 while playing the guitar, and feedback to the user, such as tips for using the electronic guitar pick 402 or how the user's technique may be improved.

Figure 5:
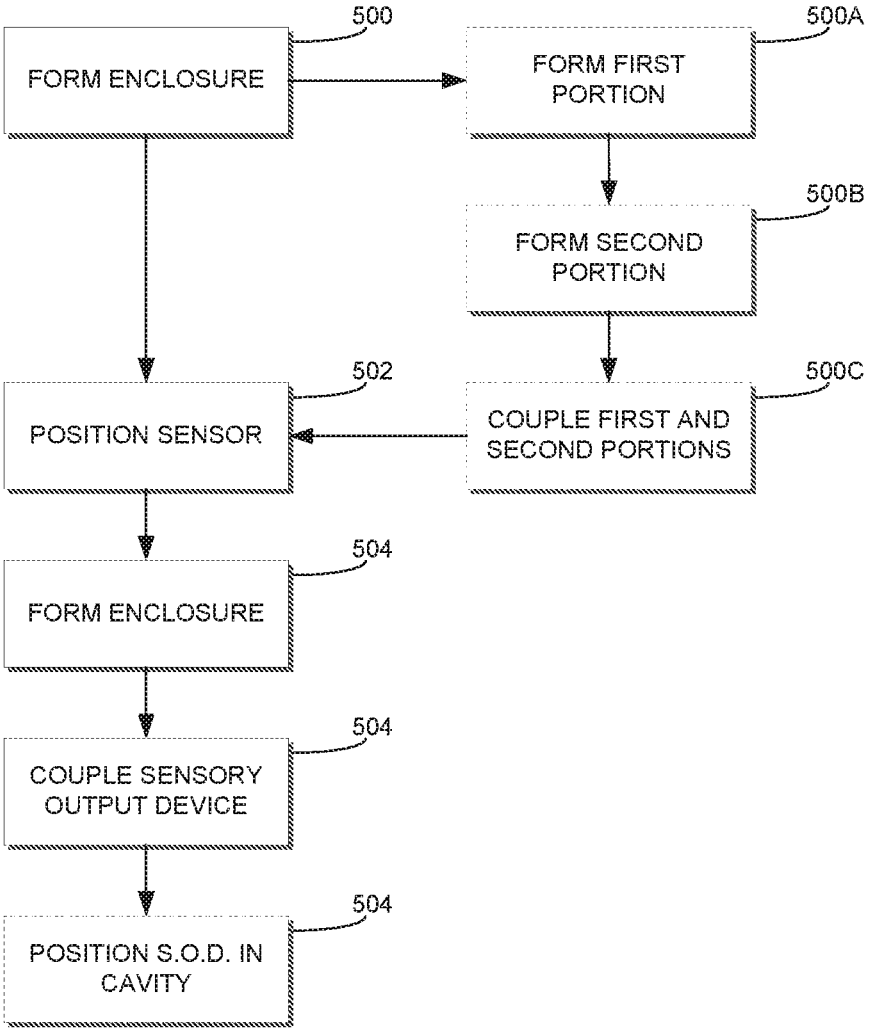
FIG. 5 is a flowchart for making an electronic guitar pick system, in an example embodiment.

FIG. 5 is a flowchart for making an electronic guitar pick system, in an example embodiment. The electronic guitar pick system may be with respect to the electronic guitar pick 100 or 402 or the system 400 or any suitable electronic guitar pick or system including an electronic guitar pick.

At operation 500, an enclosure, is formed, the enclosure forming a cavity, the enclosure having a first end that is substantially pointed and a second end opposite the first end that is substantially flat, the enclosure having a thickness proximate the cavity greater than a thickness proximate the first end.

At operation 500A, forming the enclosure optionally includes forming a first portion of the enclosure.

At operation 500B, forming the enclosure optionally includes forming a second portion of the enclosure.

At operation 500C, forming the enclosure optionally includes coupling the first portion to the second portion, forming the cavity therebetween, the enclosure having an enclosure length, the first end having a first end length less than the enclosure length, the first portion including the first end and having a first portion length substantially the same as the enclosure length, and the second portion having a second portion length equal to the enclosure length less the first end length.

At operation 502, a sensor is positioned, at least in part, within the cavity and configured to generate a sensor output based on an interaction with the enclosure. In an example, the sensor is at least one of an accelerometer, a gyroscope, and a touch sensor. In an example, the sensor output is indicative of an acceleration consistent with playing a string of an instrument. In an example, the sensor output is indicative of an acceleration consistent with movement of the enclosure along an axis not consistent with playing a string of an instrument. In an example, the sensor output is indicative of an orientation of the enclosure relative to a reference. In an example, the sensor is at least two of the accelerometer, the gyroscope, and the touch sensor, and wherein the sensor output is indicative of an output of the at least two of the accelerometer, the gyroscope, and the touch sensor.

At operation 504, a sensory output device is communicatively coupled to the sensor, the sensory output device configured to output a sensory output based, at least in part, on the sensor output.

At operation 506, the sensory output device is positioned, at least in part, within the cavity. In an example, the sensory output device is a light emitting diode (LED).

At operation 508, a wireless transmitter is coupled to the sensor, wherein the sensory output device is positioned remote to the enclosure and communicatively coupled to the wireless transmitter.

Figure 6:
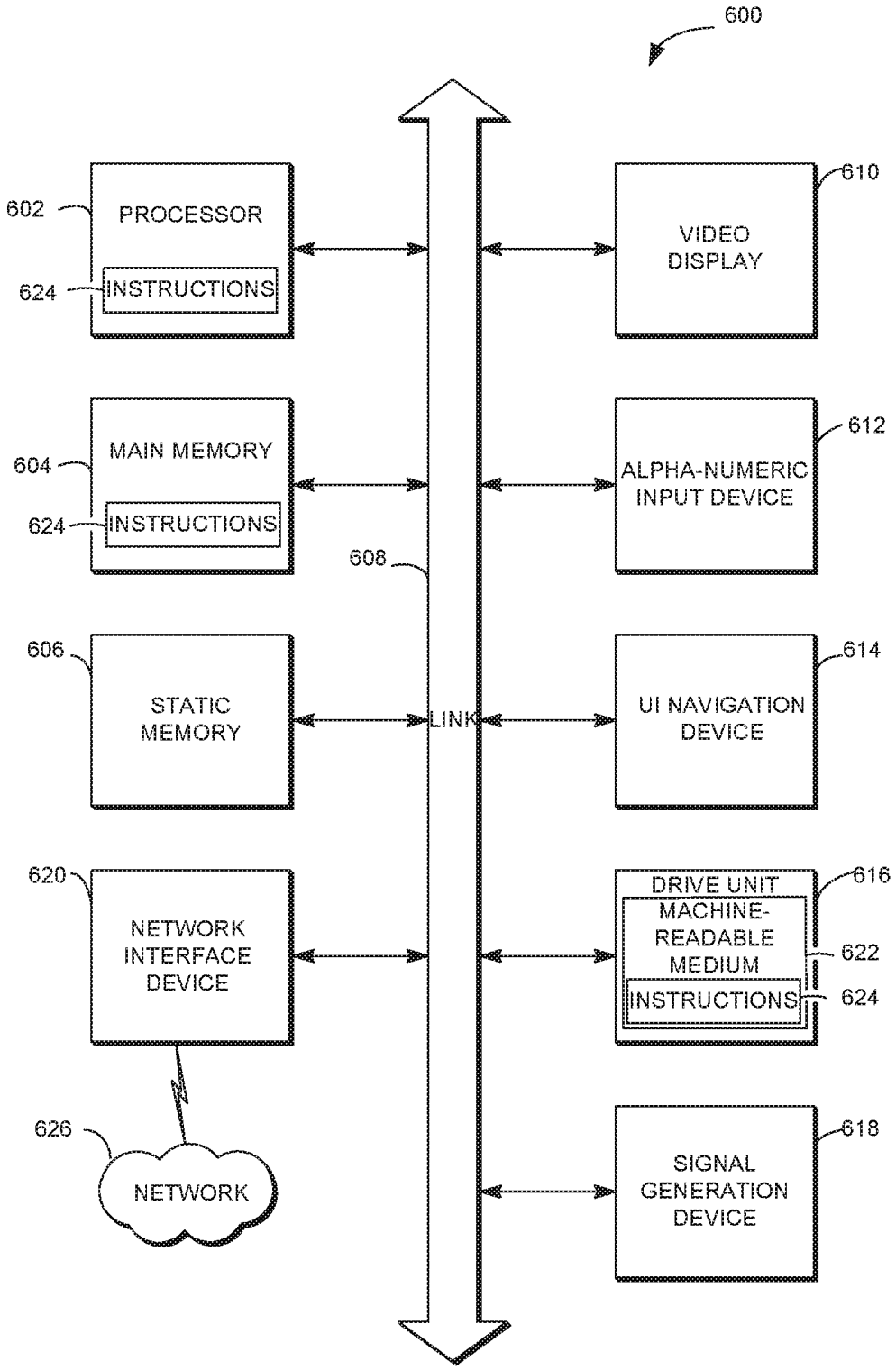
FIG. 6 is a block diagram illustrating components of a machine able to read instructions from a machine-readable medium.

FIG. 6 is a block diagram illustrating components of a machine 600, according to some example embodiments, able to read instructions from a machine-readable medium (e.g., a machine-readable storage medium) and perform any one or more of the methodologies discussed herein. Specifically, FIG. 6 shows a diagrammatic representation of the machine 600 in the example form of a computer system and within which instructions 624 (e.g., software) for causing the machine 600 to perform any one or more of the methodologies discussed herein may be executed. In alternative embodiments, the machine 600 operates as a standalone device or may be connected (e.g., networked) to other machines. In a networked deployment, the machine 600 may operate in the capacity of a server machine or a client machine in a server-client network environment, or as a peer machine in a peer-to-peer (or distributed) network environment. The machine 600 may be a server computer, a client computer, a personal computer (PC), a tablet computer, a laptop computer, a netbook, a set-top box (STB), a personal digital assistant (PDA), a cellular telephone, a smartphone, a web appliance, a network router, a network switch, a network bridge, or any machine capable of executing the instructions 624, sequentially or otherwise, that specify actions to be taken by that machine. Further, while only a single machine is illustrated, the term "machine" shall also be taken to include a collection of machines that individually or jointly execute the instructions 624 to perform any one or more of the methodologies discussed herein.

The machine 600 includes a processor 602 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory 604, and a static memory 606, which are configured to communicate with each other via a bus 608. The machine 600 may further include a graphics display 610 (e.g., a plasma display panel (PDP), a light emitting diode (LED) display, a liquid crystal display (LCD), a projector, or a cathode ray tube (CRT)). The machine 600 may also include an alphanumeric input device 612 (e.g., a keyboard), a cursor control device 614 (e.g., a mouse, a touchpad, a trackball, a joystick, a motion sensor, or other pointing instrument), a storage unit 616, a signal generation device 618 (e.g., a speaker), and a network interface device 620.

The storage unit 616 includes a machine-readable medium 622 on which is stored the instructions 624 (e.g., software) embodying any one or more of the methodologies or functions described herein. The instructions 624 may also reside, completely or at least partially, within the main memory 604, within the processor 602 (e.g., within the processor's cache memory), or both, during execution thereof by the machine 600. Accordingly, the main memory 604 and the processor 602 may be considered as machine-readable media. The instructions 624 may be transmitted or received over a network 626 via the network interface device 620.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the machine-readable medium 622 is shown in an example embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing instructions (e.g., software) for execution by a machine (e.g., machine 600), such that the instructions, when executed by one or more processors of the machine (e.g., processor 602), cause the machine to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" shall accordingly be taken to include, but not be limited to, one or more data repositories in the form of a solid-state memory, an optical medium, a magnetic medium, or any suitable combination thereof.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Examples

In Example 1, an electronic guitar pick system includes an enclosure forming a cavity, the enclosure having a first end that is substantially pointed and a second end opposite the first end that is substantially flat, the enclosure having a thickness proximate the cavity greater than a thickness proximate the first end, a sensor contained, at least in part, within the cavity and configured to generate a sensor output based on an interaction with the enclosure, and a sensory output device, communicatively coupled to the sensor, configured to output a sensory output based, at least in part, on the sensor output.

In Example 2, the system of Example 1 optionally further includes that the sensor is at least one of an accelerometer, a gyroscope, and a touch sensor.

In Example 3, the system of any one or more of Examples 1 and 2 optionally further includes that sensor is at least one of an accelerometer, a gyroscope, and a touch sensor.

In Example 4, the system of any one or more of Examples 1-3 optionally further includes that the sensor output is indicative of an acceleration consistent with movement of the enclosure along an axis not consistent with playing a string of an instrument.

In Example 5, the system of any one or more of Examples 1-4 optionally further includes that the sensor output is indicative of an orientation of the enclosure relative to a reference.

In Example 6, the system of any one or more of Examples 1-5 optionally further includes that the sensor is at least two of the accelerometer, the gyroscope, and the touch sensor, and wherein the sensor output is indicative of an output of the at least two of the accelerometer, the gyroscope, and the touch sensor.

In Example 7, the system of any one or more of Examples 1-6 optionally further includes that the sensor is at least two of the accelerometer, the gyroscope, and the touch sensor, and wherein the sensor output is indicative of an output of the at least two of the accelerometer, the gyroscope, and the touch sensor.

In Example 8, the system of any one or more of Examples 1-7 optionally further includes that the sensory output device is a light emitting diode (LED).

In Example 9, the system of any one or more of Examples 1-8 optionally further includes a wireless transmitter coupled to the sensor, wherein the sensory output device is positioned remote to the enclosure and communicatively coupled to the wireless transmitter.

In Example 10, the system of any one or more of Examples 1-9 optionally further includes that the enclosure includes a first portion and a second portion coupled to the first portion forming the cavity therebetween, the enclosure having an enclosure length, the first end having a first end length less than the enclosure length, the first portion including the first end and having a first portion length substantially the same as the enclosure length, and the second portion having a second portion length equal to the enclosure length less the first end length.

In Example 11, a method includes forming an enclosure, the enclosure forming a cavity, the enclosure having a first end that is substantially pointed and a second end opposite the first end that is substantially flat, the enclosure having a thickness proximate the cavity greater than a thickness proximate the first end, positioning a sensor, at least in part, within the cavity and configured to generate a sensor output based on an interaction with the enclosure, and communicatively coupling a sensory output device to the sensor, the sensory output device configured to output a sensory output based, at least in part, on the sensor output.

In Example 12, the method of Example 11 optionally further includes that the sensor is at least one of an accelerometer, a gyroscope, and a touch sensor.

In Example 13, the method of any one or more of Examples 11 and 12 optionally further includes that the sensor output is indicative of an acceleration consistent with playing a string of an instrument.

In Example 14, the method of any one or more of Examples 11-13 optionally further includes that the sensor output is indicative of an acceleration consistent with movement of the enclosure along an axis not consistent with playing a string of an instrument.

In Example 15, the method of any one or more of Examples 11-14 optionally further includes that the sensor output is indicative of an orientation of the enclosure relative to a reference.

In Example 16, the method of any one or more of Examples 11-15 optionally further includes that the sensor is at least two of the accelerometer, the gyroscope, and the touch sensor, and wherein the sensor output is indicative of an output of the at least two of the accelerometer, the gyroscope, and the touch sensor.

In Example 17, the method of any one or more of Examples 11-16 optionally further includes positioning the sensory output device, at least in part, within the cavity.

In Example 18, the method of any one or more of Examples 11-17 optionally further includes the sensory output device is a light emitting diode (LED).

In Example 19, the method of any one or more of Examples 11-18 optionally further includes coupling a wireless transmitter to the sensor, wherein the sensory output device is positioned remote to the enclosure and communicatively coupled to the wireless transmitter.

In Example 20, the method of any one or more of Examples 11-19 optionally further includes that wherein forming the enclosure includes forming a first portion of the enclosure, forming a second portion of the enclosure, and coupling the first portion to the second portion, forming the cavity therebetween, the enclosure having an enclosure length, the first end having a first end length less than the enclosure length, the first portion including the first end and having a first portion length substantially the same as the enclosure length, and the second portion having a second portion length equal to the enclosure length less the first end length.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, nonvolatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

What is claimed is:

1. An electronic guitar pick, comprising:

an enclosure forming a cavity, the enclosure having a first end that is substantially pointed and a second end opposite the first end that is substantially flat, the enclosure tapering to and forming a tip at the first end, the tip having a first end length;

a sensor contained, at least in part, within the cavity and configured to generate a sensor output based on an interaction with the enclosure, the sensor being an accelerometer;

a wireless transmitter, operatively coupled to the sensor, and configured to transmit a signal indicative of the sensor output to an external system, wherein the enclosure includes a first portion and a second portion coupled to the first portion forming the cavity therebetween, the enclosure having an enclosure length, the first portion including the tip and having a first portion length substantially the same as the enclosure length; and control circuitry, operatively coupled to the sensor and the wireless transmitter, configured to enable and disable operation of the wireless transmitter based, at least in part, on the sensor output being indicative of an acceleration inconsistent with playing a string of an instrument.

2. An electronic guitar pick, comprising:

an enclosure forming a cavity, the enclosure having a first end that is substantially pointed and a second end opposite the first end that is substantially flat, the enclosure tapering to and forming a tip at the first end, the tip having a first end length;

a sensor contained, at least in part, within the cavity and configured to generate a sensor output based on an interaction with the enclosure, the sensor being a gyroscope;

a wireless transmitter, operatively coupled to the sensor, and configured to transmit a signal indicative of the sensor output to an external system; wherein the enclosure includes a first portion and a second portion coupled to the first portion forming the cavity therebetween, the enclosure having an enclosure length, the first portion including the tip and having a first portion length substantially the same as the enclosure length; and control circuitry, operatively coupled to the sensor and the wireless transmitter, configured to enable and disable operation of the wireless transmitter based, at least in part, on the sensor output being indicative of an orientation of the enclosure relative to a reference plane inconsistent with playing a string of an instrument.

3. The electronic guitar pick of claim 2, wherein the sensor further comprises at least one of an accelerometer and a touch sensor, and control circuitry is further configured to enable and disable operation of the wireless transmitter based on the sensor output being indicative of an output of the at least two of the accelerometer, the gyroscope, and the touch sensor inconsistent with playing a string of an instrument.

4. A method, comprising:

forming an enclosure, the enclosure forming a cavity, the enclosure having a first end that is substantially pointed and a second end opposite the first end that is substantially flat, the enclosure tapering to and forming a tip at the first end, the tip having a first end length;

positioning a sensor, at least in part, within the cavity and configured to generate a sensor output based on an interaction with the enclosure, the sensor being an accelerometer;

coupling a wireless transmitter to the sensor, the wireless transmitter configured to transmit a signal indicative of the sensor output to an external system, wherein the enclosure includes a first portion and a second portion coupled to the first portion forming the cavity therebetween, the enclosure having an enclosure length, the first portion including the tip and having a first portion length substantially the same as the enclosure length; and coupling control circuitry to the sensor and the wireless transmitter, the control circuitry configured to enable and disable operation of the wireless transmitter based, at least in part, on the sensor output being indicative of an acceleration inconsistent with playing a string of an instrument.

5. A method, comprising:

forming an enclosure, the enclosure forming a cavity, the enclosure having a first end that is substantially pointed and a second end opposite the first end that is substantially flat, the enclosure tapering to and forming a tip at the first end, the tip having a first end length;

positioning a sensor, at least in part, within the cavity and configured to generate a sensor output based on an interaction with the enclosure, the sensor being a gyroscope;

coupling a wireless transmitter to the sensor, the wireless transmitter configured to transmit a signal indicative of the sensor output to an external system, wherein the enclosure includes a first portion and a second portion coupled to the first portion forming the cavity therebetween, the enclosure having an enclosure length, the first portion including the tip and having a first portion length substantially the same as the enclosure length; and coupling control circuitry to the sensor and the wireless transmitter, the control circuitry configured to enable and disable operation of the wireless transmitter based, at least in part, on the sensor output being indicative of an orientation of the enclosure relative to a reference plane inconsistent with playing a string of an instrument.

6. The method of claim 5, wherein positioning the sensor further comprises positioning at least one of an accelerometer and a touch sensor at least in part within the cavity, and wherein control circuitry is further configured to enable and disable operation of the wireless transmitter based on the sensor output being indicative of an output of the at least two of the accelerometer, the gyroscope, and the touch sensor inconsistent with playing a string of an instrument.

* * * * *